United States Patent [19]

Sobolewski

[11] Patent Number: 4,602,140

[45] Date of Patent: Jul. 22, 1986

[54] INDUCTION FLUID HEATER

[75] Inventor: Antoni Sobolewski, S.Bernardo do Campo, Brazil

[73] Assignee: Mangels Industrial S.A., Sao Paulo, Brazil

[21] Appl. No.: 667,463

[22] Filed: Nov. 1, 1984

[51] Int. Cl.[4] ..... H05B 6/10

[52] U.S. Cl. ..... 219/10.51; 219/10.65; 219/10.75; 219/10.79

[58] Field of Search ..... 219/10.51, 10.49 R, 219/10.65, 10.79, 10.75

[56] References Cited

U.S. PATENT DOCUMENTS

| | | | |
|---|---|---|---|
| 1,513,087 | 10/1924 | Buhl et al. | 219/10.51 |
| 1,999,446 | 4/1935 | Delano | 219/10.51 |
| 2,226,446 | 12/1940 | Smith et al. | 219/10.51 X |
| 3,046,378 | 7/1962 | Holz | 219/10.51 |
| 3,388,230 | 6/1968 | Cunningham et al. | 219/10.51 |
| 3,414,698 | 12/1968 | Bedford et al. | 219/10.51 |
| 4,136,276 | 1/1979 | Ashe | 219/10.51 X |
| 4,341,936 | 7/1982 | Virgin | 219/10.51 |
| 4,511,777 | 4/1985 | Gérard | 219/10.49 R X |

*Primary Examiner*—Philip H. Leung

*Attorney, Agent, or Firm*—Christie, Parker & Hale

[57] ABSTRACT

The present invention deals with a new and efficient heater for fluids in general, wherein the heat is generated by means of electromagnetic induction directly on the duct where the fluid circulates. The heater as described may be constructed according to two preferred embodiments which generally consist in disposing a magnetic core having a mono, a bi, a tri or a polyphase primary winding and on which is arranged a series of straight tubes disposed transversely or longitudinally in respect to the magnetic core. The tubes are soldered at their ends to compartments which act as reservoirs for the fluids to be heated, and, for the fact of being conductive as the tubes, they function as a secondary on which a short-circuit current is induced by the primary, thus causing the heating of the tubes.

4 Claims, 6 Drawing Figures

INDUCTION FLUID HEATER

FIELD OF THE INVENTION

The present invention relates to a new and efficient heater for fluids wherein heat is generated by means of electromagnetic induction directly in the conductor along which the fluid to be heated circulates.

BACKGROUND OF THE INVENTION

In the present state of the art, heating systems for fluid are comprised in two major groups: the one related to (1) burners using liquid fuels; and (2) the electric heaters.

In the first group of heaters there is a series of drawbacks in respect to operation of such burners. There are risks of explosions through inadequate use or careless ignition of the system; there are pollution problems generated by the burning of fuel oil, low efficiency rates when compared to other sources of heat; as well as high maintenance costs due to wear both of the burners and tubes which directly receive the flames. In addition, burners of the first group require appropriate installation and special operation sites which often demand the construction of long and complex fluid feeding lines.

As to the electric heaters, heating may be obtained by electric resistance in water or other fluids or by means of electrodes immersed in water, as in the case of boilers. The maintenance of the water used within optimum characteristics requires however constant attention so that the operation and vapor generation conditions do not deteriorate, and besides, there is the need of periodic replacement of electrodes due to wear.

SUMMARY OF THE INVENTION

In order to overcome the aforesaid disadvantages the present invention proposes an inductive electric heater which generally operates in the manner of a transformer and is provided with a magnetic core receiving a primary winding therein, said primary winding being connected to a voltage source which may be fixed or variable, said primary winding being provided thereon with a tubular secondary winding which is thermally and electrically insulated and has short circuitry in its outlets.

The heater of the present invention may also be arranged with a conventional assembly consisting of a pump and a reservoir for the heated fluid of the type used in conventional boilers, both in electrical boilers and boilers actuated by the burning of fuels, said pump and reservoir assembly being coupled to the fluid inlet and outlet in the tubular secondary winding.

The hereinabove described heater may be constructed in two other modes which provide for a more efficient industrial utilization of the heater and wherein a magnetic core is provided with a primary winding which may be a mono, a bi, a tri or a polyphase primary, said primary having a series of straight tubes disposed transversely or longitudinally in respect to the magnetic core, said tubes being soldered at their ends to compartments which function as reservoirs for the fluids to be heated. Because such reservoirs are electrical conductors as much as the tubes are, they operate as a secondary winding in which a short-circuit current is induced by the primary winding thus causing the heating of the tubes.

BRIEF DESCRIPTION OF THE DRAWINGS

For a better understanding of the invention, it will be described in connection with the appended drawings, by way of example only, in which.

DETAILED DESCRIPTION

Figure 1:
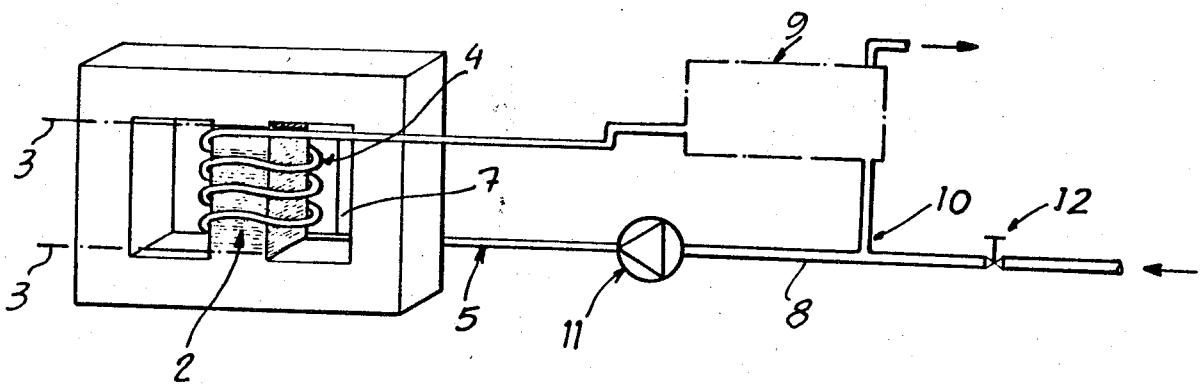
FIG. 1 is a schematic view of the heater of the present invention incorporated in a complementary heated fluid generator assembly.
Figure 2:
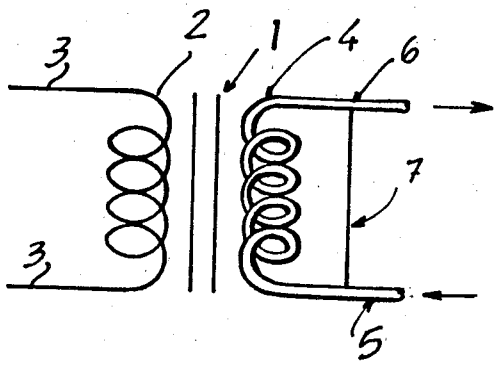
FIG. 2 is a schematic view of the heater of the present invention as if it were a voltage transformer.

According to the attached drawings, the heater of the present invention comprises a magnetic core 1 (FIG. 1), in which is wound a primary winding 2 the terminals 3 of which are connected to a voltage source of the fixed or variable type, and of a fixed or a variable frequency, a tubular secondary winding 4 being disposed on the primary winding 2 and having its inlet 5 and outlet 6 interconnected in short circuit by a conductor 7, said inlet 5 and outlet 6 being connected to ducts 8 for the circulation of fluid, said ducts being coupled to suitable equipment, such as a reservoir 9 having a return member 10, a pump 11, and a valve 12.

In this embodiment, whenever an alternating voltage is applied to the primary winding, such voltage induces a voltage on the secondary winding which generates a short-circuit current due to the fact that the secondary winding is in short circuit by means of conductor 7.

The short-circuit current on the secondary winding heats the latter which on being tubular transfers the heat generated to the fluid circulating within said secondary winding.

Of course as the tubular secondary winding is insulated both thermally and electrically, all of the heat is practically transferred to the fluid thus resulting in reduced heat losses and high efficiency rates.

Since the heater uses the principles of operation of a transformer, its efficiency will be similar to the one of a transformer, but increasingly higher, for the fact that in a transformer there are two groups of losses, in iron and in copper.

The so-called losses in iron are the actual losses experienced by the heater since they relate to the magnetic permeability of the magnetic core. Such losses vary as a result of how said core is manufactured, for instance, in case of cores having thicker or thinner laminations.

As to the losses in copper deriving from the Joule effect, which generates heat by means of the passage of an electric current through a conductor, said losses are undesirable in a transformer since they mean loss of power output, but in case of a heater such losses are caused deliberately. Copper losses are used to advantage in the secondary winding since the heat generated is also utilized in heating fluid.

In that manner, for example, it is assumed that for a given transformer with an efficiency rate of 97%, a heater having similar construction characteristics will have an efficiency rate of 98%, all proportions being duly taken into account.

The power output of the heater of the present invention will be defined by the product of the square of the current circulating within the secondary by the ohmic resistance of the tube which constitutes it. In view of this, a suitable raw material will be used for making the tube, taking into account each of the purposes the tube will be used for, and to that effect tubes will be made of stainless steel or any other non-magnetic metallic material. The other features of the system, such as the number of coils, spacing and diameters will be assessed for each application, and so will the voltage applied to the primary, whether a monophase or a polyphase voltage.

An accurate control of the temperature and amount of the fluid may be made in a very simple way by means of a controlled variable flow pump, and/or by the use of a voltage regulator at the voltage input in the primary, said regulator possibly being associated to a thermocouple disposed at the flow outlet of the heater.

Due to the fact that it has a construction of the modular type, the heater of the present invention may be disposed on the desired site, eliminating the need for heating supply lines which are oftentimes expensive both in installation and maintenance, as for example, in chemical product plants which sometimes require temperature raising or lowering at each step.

The system of the present invention operates noiselessly and in a condition of total safety, and it may be placed in sites where such characteristics are necessary and desirable, for example, in hospitals or similar facilities.

In a second embodiment of the present invention (FIGS. 3 and 4), the inductive heater may comprise a mono or a polyphase magnetic core 1' provided with a primary winding 2'. The core 1' has a plurality of legs 13, each leg including a primary winding 2, and laterally in respect to winding 2, there are provided straight tubes 4' which are current carriers and preferably have a circular cross-section. The ends of the tubes 4' are attached to reservoirs 14 having current-carrying walls formed by flange 15 to which a cover 16 is associated. Such reservoirs are provided with inlet or outlet ducts 17.

Figure 5:
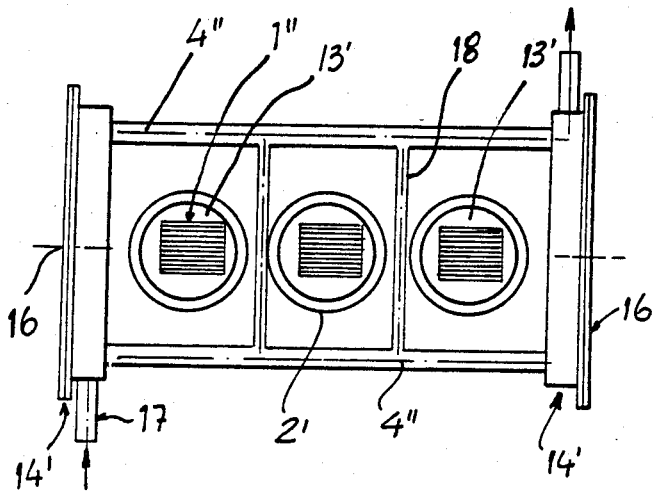
FIG. 5 is a schematic sectional view of a third embodiment of the triphase heater provided with straight tubes disposed longitudinally of the magnetic core.
Figure 6:
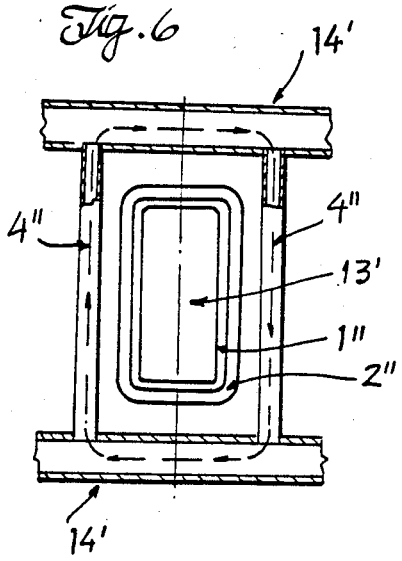
FIG. 6 is a schematic view showing in detail the circulation of current through tubes and flanges thus forming a closed coil.

In a third mode of construction of the present invention (FIGS. 5 and 6), a mono or a polyphase core 1'' provided with a primary winding 2'' receives externally and longitudinally of legs 13' a series of current-carrying parallel straight tubes 4'', of a preferably circular cross-section. The ends of tubes 4'' are attached to identical conductive reservoirs 14'. Between legs 13' are disposed auxiliary electric conductors 18 for closing up of the coils in order to permit current circulation.

In the above described embodiments, the heater essentially allows that the parallel straight tubes facilitate access to the interior of the system in order to improve internal cleaning conditions by chemical or mechanical means. To that effect, it is only necessary to remove covers 16 to have the extremities of said tubes 4' or 4'' exposed.

The heating of tubes 4' or 4'' is made by means of a current induced by primary 2' or 2'' on the secondary. The secondary is formed by tubes 4' or 4'' and by reservoirs 14, which make up the circuit and maintain it as a short circuit.

Figure 3:
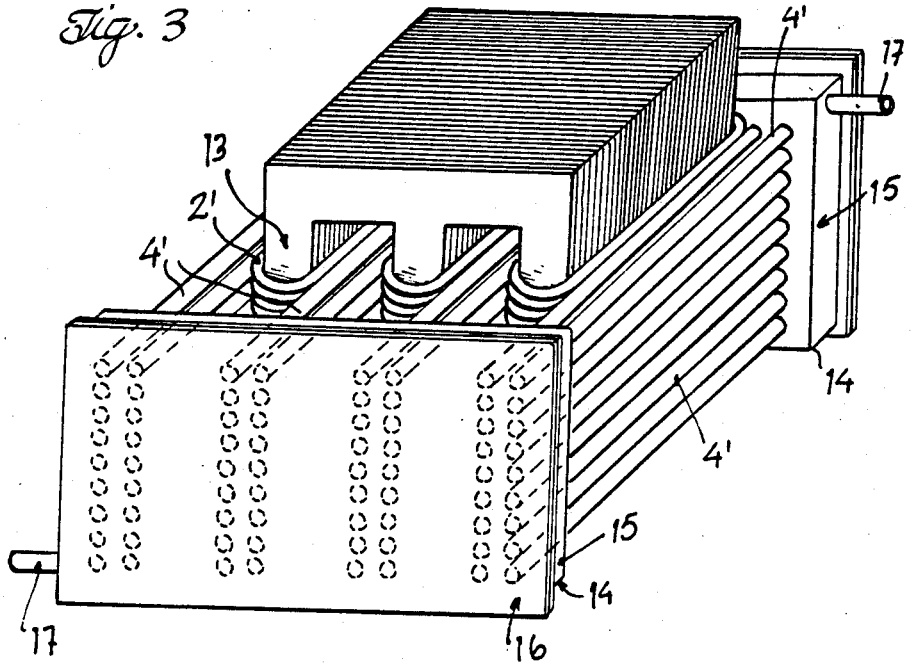
FIG. 3 is a perspective view of a second embodiment of the inductive heater of the present invention, wherein straight tubes are applied to a magnetic core provided with a primary triphase winding, the tubes being transverse in respect to the core.
Figure 4:
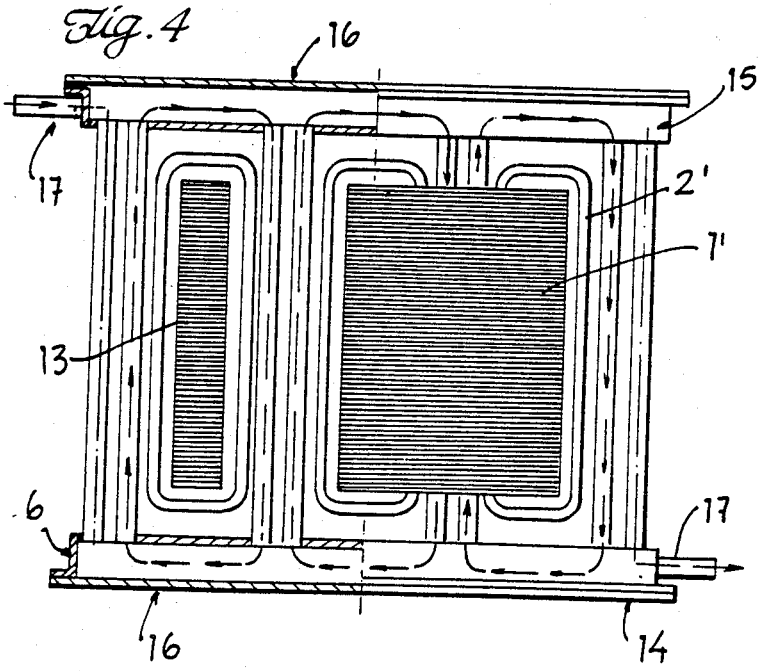
FIG. 4 shows a plan view, partially in section, of the heater shown in the preceding figure.

The arrows in FIGS. 3 and 4 indicate the direction of the current induced on secondary 4''. Each pair of tubes form a circuit together with the reservoirs and act as if they were a coil for the secondary in short circuit.

I claim:

1. An inductive electric heater for heating a fluid comprising a magnetic core, a primary winding wound on the core adapted to be connected to an alternating voltage source of any given frequency, a tubular secondary winding coupled magnetically to the primary winding by means of the magnetic core, the magnetic core having a plurality of legs on which the primary winding is wound, the secondary winding including a plurality of straight tubes extending between the legs and laterally of the legs outside the core, the tubes extending parallel to the primary winding, fluid reservoirs to which the ends of at least a portion of the tubes are connected, the reservoirs and tubes being non-magnetic and electrically conductive, and means directing fluid into one reservoir and out the other reservoir through the tubes.

2. Apparatus of claim 1 in which all the tubes extend parallel to each other between the two reservoirs.

3. Apparatus of claim 1 in which the tubes extending between the legs intersect the tubes extending laterally of the legs.

4. Apparatus of claim 1 in which the reservoirs include removable covers for opening the reservoirs and exposing the ends of the tubes connected to the reservoirs.

* * * * *